US011507118B2

(12) United States Patent
Daley et al.

(10) Patent No.: US 11,507,118 B2
(45) Date of Patent: Nov. 22, 2022

(54) CONTROL SYSTEM FOR DETERMINING A TAP POSITION OF A TAP CHANGING MECHANISM OF A VOLTAGE REGULATION DEVICE

(71) Applicant: Eaton Intelligent Power Limited, Dublin (IE)

(72) Inventors: Daniel Joseph Daley, Waukesha, WI (US); Fred Joseph Rapant, South Milwaukee, WI (US); Richard John Kaluzny, Greenfield, WI (US); Daniel Michael Sauer, Port Washington, WI (US); Kyle James Heiden, Milwaukee, WI (US)

(73) Assignee: Eaton Intelligent Power Limited, Dublin (IE)

( * ) Notice: Subject to any disclaimer, the term of this patent is extended or adjusted under 35 U.S.C. 154(b) by 164 days.

(21) Appl. No.: 16/743,043

(22) Filed: Jan. 15, 2020

(65) Prior Publication Data

US 2020/0249709 A1 Aug. 6, 2020

Related U.S. Application Data

(60) Provisional application No. 62/799,830, filed on Feb. 1, 2019.

(51) Int. Cl.
*G05F 1/14* (2006.01)

(52) U.S. Cl.
CPC ..... *G05F 1/14* (2013.01)

(58) Field of Classification Search
CPC ..... H02M 7/00; H02M 7/043; H02M 2001/0003; H02M 2007/217; G05F 1/147;

(Continued)

(56) References Cited

U.S. PATENT DOCUMENTS 2,690,535 A * 9/1954 Douma ..... G05F 1/34 323/301
2,786,968 A * 3/1957 Kabak ..... G05F 1/32 315/259

(Continued)

FOREIGN PATENT DOCUMENTS

WO 2016022230 A1 2/2016

OTHER PUBLICATIONS

SEL-2431 Voltage Regulator Control, SEL-2431 Data Sheet, Schweitzer Engineering Laboratories, Inc., 2016 (20 pages total).

(Continued)

*Primary Examiner* — Kevin J Comber
*Assistant Examiner* — Nusrat Quddus
(74) *Attorney, Agent, or Firm* — DiBerardino McGovern IP Group LLC

(57) ABSTRACT

A control system for a voltage regulation device is configured to determine a tap position of a tap changing mechanism of the voltage regulation device, the control system being configured to: determine an internal impedance of the voltage regulation device based on an initial tap position; determine a voltage of the internal impedance based on a measured load current; determine a voltage of the first winding based on the input voltage, the output voltage, and the voltage of the internal impedance; and determine the tap position based on the voltage of the first winding, N, and a voltage of a second winding, where N is an integer value that represents a count of turns on the second winding.

25 Claims, 8 Drawing Sheets

(58) Field of Classification Search
CPC ... G05F 1/153; G05F 1/16; G05F 1/20; G05F 1/253; G05F 1/33; G05F 1/34; G05F 1/38; H01H 9/0005; H01H 9/0011; H01H 9/0016; H01H 9/0027; H01H 9/0033
See application file for complete search history.

(56) References Cited

U.S. PATENT DOCUMENTS 3,252,078 A * 5/1966 Conner ..... G05F 1/153 327/540
4,090,225 A * 5/1978 Gilker ..... G01R 31/00 361/5
4,330,815 A * 5/1982 Konishi ..... H02J 3/36 363/35
4,419,619 A 12/1983 Jindrick et al.
5,530,338 A * 6/1996 Beckwith ..... G05F 1/14 323/255
5,550,459 A 8/1996 Laplace
5,623,580 A * 4/1997 Inoue ..... G06Q 10/06 706/45
5,633,580 A 5/1997 Trainor et al.
5,645,512 A * 7/1997 Yu ..... A63B 22/0064 482/53
5,789,907 A * 8/1998 Casagrande ..... G05F 7/00 336/155
6,078,148 A * 6/2000 Hochstein ..... H05B 45/18 307/115
6,472,850 B2 10/2002 Fletcher et al.
7,482,714 B2 1/2009 Rapant et al.
9,349,547 B2 5/2016 Schaar
9,438,036 B2 9/2016 Kaluzny et al.
9,679,710 B1 * 6/2017 Schaar ..... G05F 1/14
2002/0067153 A1 * 6/2002 Fletcher ..... G05F 1/14 323/201
2003/0076075 A1 * 4/2003 Ma ..... H02J 3/1864 323/209
2007/0024254 A1 * 2/2007 Radecker ..... H05B 45/14 323/247
2007/0090811 A1 * 4/2007 Labuschagne ..... G05F 1/70 323/217
2015/0162144 A1 * 6/2015 Panosyan ..... H01H 9/0011 200/11 TC
2016/0079645 A1 * 3/2016 Corum ..... H01Q 9/30 333/240
2018/0233895 A1 * 8/2018 O'Regan ..... H02H 3/042
2020/0057461 A1 * 2/2020 Schaar ..... G05F 1/20

OTHER PUBLICATIONS

Accu/Stat® MJ-5™ voltage regulator control, Siemens AG, 2013 (1 page).
Digital Tapchanger Control M-2001D, Beckwith Electric Co., Inc., 2008 (4 pages total).
Digital Voltage Regulator Control M-6200A, Beckwith Electric Co., Inc., 2006 (4 pages total).
CL-7 Voltage Regulator Control; Installation, Operation, and Maintenance Instructions, Publication No. MN225003EN, Eaton, 2018 (188 pages total).
Filippo Bellatalla, European International Searching Authority, International Search Report and Written Opinion, counterpart PCT Application No. PCT/EP2020/025046 dated May 18, 2020, 14 pages total.

* cited by examiner

CONTROL SYSTEM FOR DETERMINING A TAP POSITION OF A TAP CHANGING MECHANISM OF A VOLTAGE REGULATION DEVICE

CROSS-REFERENCE TO RELATED APPLICATION

This application claims the benefit of U.S. Provisional Application No. 62/799,830, filed on Feb. 1, 2019 and titled CONTROL SYSTEM FOR A VOLTAGE REGULATION DEVICE, which is incorporated herein by reference in its entirety.

TECHNICAL FIELD

This disclosure relates to a control system for a voltage regulation device. The voltage regulation device may be, for example, a load tap changer, a line voltage regulator, or a step voltage regulator. The voltage regulation device is used in an electrical power distribution network.

BACKGROUND

Voltage regulation devices are used to monitor and control a voltage level in an electrical power distribution system.

SUMMARY

In one aspect, a control system for a voltage regulation device is configured to determine a tap position of a tap changing mechanism of the voltage regulation device, the control system including: one or more electronic processors; and a non-transitory machine readable storage medium including instructions, that when executed, cause the one or more electronic processors to: determine an internal impedance of the voltage regulation device based on an initial tap position; determine a voltage of the internal impedance based on a measured load current; determine a voltage of the first winding based on the input voltage, the output voltage, and the voltage of the internal impedance; and determine the tap position based on the voltage of the first winding, N, and a voltage of a second winding, where N is an integer value that represents a count of turns on the second winding.

Implementations may include one or more of the following features. The instructions also may include instructions that, when executed, cause the one or more electronic processors to: compare the determined tap position to the initial tap position, and determine whether to reassess the initial tap position based on the comparison. To reassess the initial tap position, the instructions also may include instructions that, when executed, cause the one or more electronic processors to: determine a second internal impedance of the voltage regulation device based on a second initial tap position; determine a voltage of the second internal impedance based on a measured load current; determine a second voltage of the first winding based on the input voltage, the output voltage, and the voltage of the second the internal impedance; and determine a second tap position of the tap changing mechanism based on the second voltage of the first winding, N, and the voltage of the second winding. The second initial tap position may include the initial tap position increased or decreased by a pre-set amount.

The instructions that, when executed, cause the one or more electronic processors to compare the determined tap position to the initial tap position may include instructions configured to determine a difference between the determined tap position and the initial tap position or a difference between a value associated with the determined tap position and a value associated with the initial tap position. The determined tap position may be reassessed if the difference does not meet a specification. In some implementations, the difference does not meet the specification if the difference is outside of a range of values or if the difference is not equal to a pre-determined value. The control system also may include an output interface configured to provide an indication of the difference not meeting the specification. The output interface may include an interface configured to communicate with a remote station that is separate from the voltage regulation device, and the output interface may provide the indication of the difference not meeting the specification to the remote station.

In another aspect, a voltage regulation device includes: a first winding including: M turns, where M is an integer that is greater than one; T taps, where T is an integer that is greater than one and at least one of the M turns is between any two of the T taps; an input node configured to receive an input voltage; an output node configured to provide an output voltage to a load; a tap changing mechanism including a movable electrical contact configured make electrical contact with at least one of the T taps; a second winding electrically connected to the first winding, the second winding including N turns, where N is an integer that is at least one; and a control system configured to determine a tap position of the tap changing mechanism, the tap position being a value that indicates which of the T taps is connected to the movable electrical contact, and the control system being configured to determine the tap position includes the control system being configured to: determine an internal impedance of the voltage regulation device based on an initial tap position; determine a voltage of the internal impedance based on a measured load current; determine a voltage of the first winding based on the input voltage, the output voltage, and the determined voltage of the internal impedance; and determine the tap position based on the voltage of the first winding, N, and a voltage of the second winding.

Implementations may include one or more of the following features. The control system may be further configured to: compare the determined tap position to the initial tap position.

The second winding may be electrically connected to the input node of the first winding, and, in these implementations, the voltage of the second winding is the input voltage.

The second winding may be electrically connected to the output node of the first winding, and, in these implementations, the voltage of second winding is the output voltage.

The voltage regulation device also may include a differential potential transformer configured to measure a voltage difference between the input node and the output node, and the control system being configured to determine a voltage of the first winding based on the input voltage, the output voltage, and the voltage of the internal impedance may include the control system being configured to determine the voltage of the first winding based on the measured voltage difference and the voltage of the internal impedance.

The voltage regulation device also may include a load potential transformer and a source potential transformer, where the load potential transformer is configured to measure the output voltage, and the source potential transformer is configured to measure the input voltage, and where the control system being configured to determine a voltage of the first winding based on the input voltage, the output voltage, and the voltage of the internal impedance includes the control system being configured to determine the voltage of the first winding based on the input voltage measured by the source potential transformer, the output voltage measured by the load potential transformer, and the voltage of the internal impedance.

In another aspect, a method of determining a tap position of a voltage regulation device includes: determining an internal impedance of the voltage regulation device based on an initial tap position; determining a voltage of the internal impedance based on a measured load current; determining a voltage of the first winding based on the input voltage, the output voltage, and the voltage of the internal impedance; and determining the tap position based on the voltage of the first winding.

Implementations may include one or more of the following features. The determined tap position may be compared to the initial tap position; it may be determined if the initial tap position is valid based on the comparison; and if the initial tap position is invalid: the initial tap position may be changed to a second tap position; and a new tap position may be determined based on the second tap position. If the second tap position is invalid, the initial tap position may be changed at least one more time, a new tap position may be determined for each changed tap position, the validity of each new determined tap position is determined; and if no valid tap position is found, a perceivable indication related to no valid tap position being found may be provided to a remote station or to a separate electrical apparatus. If a valid tap position is found, providing information related to the valid tap position to a remote station or a separate electrical apparatus.

In some implementations, a request to determine the tap position is received prior to determining the internal impedance of the voltage regulation device.

Implementations of any of the techniques described herein may include a voltage regulation device, a system that includes a voltage regulation device and a control system configured to control the voltage regulation device, software stored on a non-transitory computer readable medium that, when executed, controls a voltage regulation device, a kit for retrofitting a voltage regulation device, and/or a method. The details of one or more implementations are set forth in the accompanying drawings and the description below. Other features will be apparent from the description and drawings, and from the claims.

DRAWING DESCRIPTION

DETAILED DESCRIPTION

Techniques for determining a tap position of a tap changing mechanism of a voltage regulation device are disclosed.

Figure 1A:
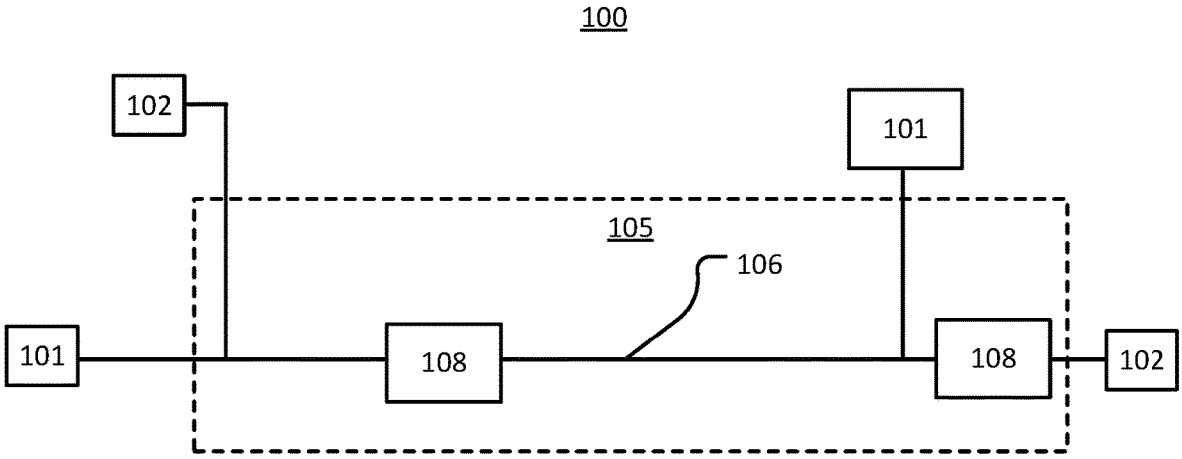
FIG. 1A is a block diagram of an example of an electrical power system.
Figure 1B:
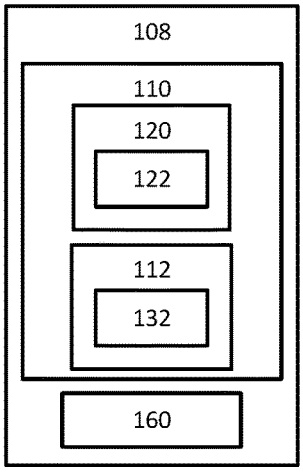
FIG. 1B is a block diagram of an example of a voltage regulation system.

Referring to FIG. 1A, a block diagram of an example of an electrical power system 100 is shown. The power system 100 includes an electrical power distribution network 105, which distributes electricity from power sources 101 to electrical loads 102 via a distribution path 106. The power system 100 includes voltage regulation systems 108. Referring also to FIG. 1B, each voltage regulation system 108 includes a voltage regulation device 110 and a control system 160. The voltage regulation systems 108 monitor and control the voltage level in the power distribution network 105. For example, the voltage regulation systems 108 may be used to maintain a steady-state voltage of the electrical power distribution network 105, or of a portion of the network 105, within a voltage range such that the voltage level at the load 102 also stays within an acceptable range. Each voltage regulation system 108 may be any type of electrical, mechanical, or electro-mechanical device that is capable of performing a voltage regulation operation that changes the voltage on the distribution path 106. The voltage regulation system 108 may be, for example, a on load-tap changer (OLTC) or a step voltage regulator.

Each voltage regulation device 110 includes a tap changing mechanism 112, and a coil or a transformer 120 that includes taps 122. The tap changing mechanism 112 includes one or more electrical contacts 132 that are moveable relative to the coil 120. The coil 120 is electrically connected to the load 102 when at least one of the taps 122 is in contact with the electrical contacts 132. The amount of voltage provided to the load 102 depends on which of the taps 122 are in electrical contact with the contacts 132. The position of the contacts 132 relative to the taps 122 is the tap position.

Tracking the actual position of the electrical contacts 132 to determine which of the taps 122 is connected to the contacts 132 may be challenging. However, knowledge of the precise position of the electrical contacts 132 relative to the taps 122 is important for robust and reliable operation of the power system 100. For example, knowledge of the tap position is used to track the range and/or frequency of changes in tap position and/or the amount of time the electrical contacts 132 are in contact with a particular tap 122. This information may be analyzed and used to determined, for example, an expected remaining lifetime of the voltage regulation system 108, the coil 120, the contacts 132, and/or the tap 122. In another example, for maintenance and safety reasons, it may be important to know when the tap position is at the neutral tap of the voltage regulation system 108. In another example, the sequence or operation of the tap changing mechanism may vary depending on the actual tap position. Thus, knowledge of the tap position may be important to the proper operation of the power system 100, the voltage regulation system 108 and other electrical apparatuses in the power system 100.

The control system 160 implements a process that reliably indicates the actual tap position. Moreover, the control system 160 implements a technique that can be used to detect and/or verify that a tap change, whether commanded remotely, locally, intentionally or unintentionally, was performed to properly update the tap counter and indication status.

Various techniques for estimating the tap position in a voltage regulation device are known. For example, the tap position may be known from a position sensor that is mechanically coupled to a tap changing mechanism. However, this approach requires that additional equipment (such as the position sensor and associated electronics and software) be included in the voltage regulation system 108 and mechanical failure in the sensing or indicating linkage may result in error. Moreover, for economic and/or technical reasons, installation of a position sensor is not feasible for all voltage regulation systems. In another example, the tap position may be estimated using a current or voltage sensor that detects the energization of a motor that drives the tap changing mechanism and incrementing a counter each time energization is detected. Such an approach also requires additional hardware and software and is not practical for all voltage regulation systems. Furthermore, such an approach only measures relative changes in position and may provide an inaccurate estimate of the tap position because a tracking error will be carried through until a manual or automatic synchronization is performed.

On the other hand, the control system 160 implements a technique that uses measured properties (such as current and voltages) that are already collected in the course of operating the voltage regulation device 110 in conjunction with known properties of the voltage regulation device 110 to determine the position of the tap 122. In this way, the control system 160 determines the position of the tap 122 accurately and without requiring the installation of additional hardware or reconfiguration of the voltage regulation device 110. Moreover, the control system 160 makes use of information that is already available and thus results in an efficient and cost-effective monitoring system.

The electrical power distribution network 105 may be, for example, an electrical grid, an electrical system, or a multi-phase electrical network that provides electricity to commercial and/or residential customers. The power distribution network 105 may have an operating voltage of, for example, at least 1 kilovolt (kV), up to 34.5 kV, up to 38 kV, up to 69 kV, or 69 kV or higher. The power distribution network 105 is an alternating current (AC) electrical network and may operate at a fundamental frequency of, for example, 50-60 Hertz (Hz). The distribution path 106 may include, for example, one or more distribution lines, electrical cables, and/or any other mechanism for transmitting electricity.

The electrical loads 102 may be any device that utilizes electricity and may include electrical equipment that receives and transfers or distributes electricity to other equipment in the electrical power distribution network 105. The electrical loads 102 may include, for example, transformers, switchgear, energy storage systems, computer and communication equipment, lighting, heating and air conditioning, motors and electrical machinery in a manufacturing facility, and/or electrical appliances and systems in a residential building.

The power source 101 may be any source of electricity such as, for example, a power plant that generates electricity from fossil fuel or from thermal energy or an electrical substation. The power sources 101 may include one or more distributed energy resources, such as, for example, a solar energy system that includes an array of photovoltaic (PV) devices that convert sunlight into electricity or a wind-based energy system. More than one power source may supply electricity to the electrical distribution network 105, and more than one type of power source may supply electricity to the electrical distribution network 105.

Figure 2A:
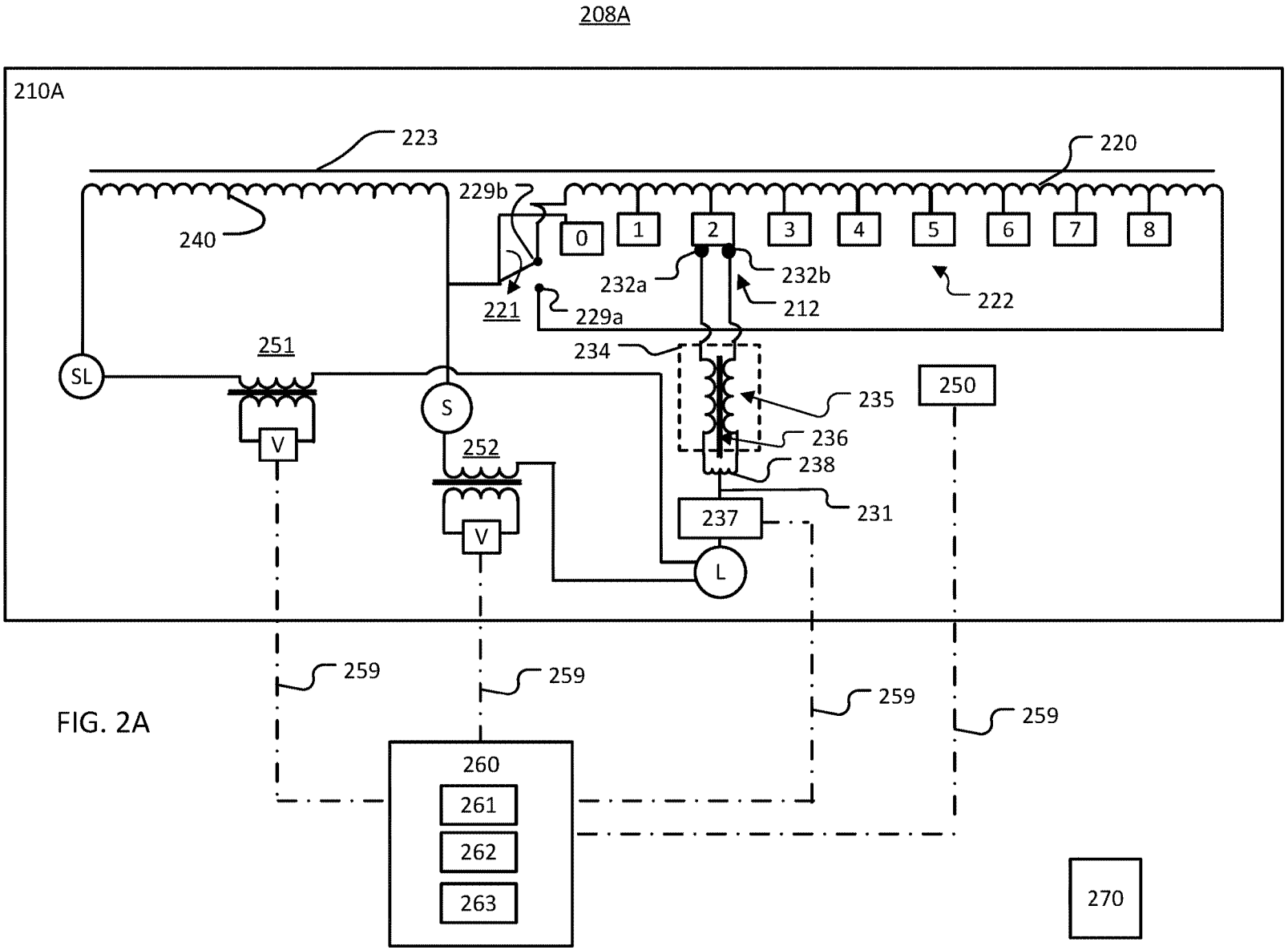
FIGS. 2A and 2C are schematics of examples of voltage regulation systems.

FIG. 2A is a schematic diagram of a voltage regulation system 208A. The voltage regulation system 208A is an example of an implementation of the voltage regulation system 108 of FIGS. 1A and 1B. The voltage regulation system 208A may be used in the power system 100 (FIG. 1A). In FIG. 2A, the lines having a dash-dot-dash style indicate a data link 259 over which data, such as, for example, information, commands, or numerical data, travel. The data may be in the form of electrical signals. The voltage regulation system 208A includes more than one instance of the data link 259. The data links 259 may be formed with any type of wired or wireless medium that is capable of transmitting information. For example, the data links 259 may be electrical cables.

The voltage regulation system 208A includes a voltage regulation device 210A and a control system 260. The voltage regulation device 210A includes source, load, and source-load terminals, which are labeled, respectively, S, L, and SL. The voltage regulation system 208A or the voltage regulation device 210A may be enclosed in a housing (not shown). In these implementations, each of the S, L, and SL terminals is part of a bushing that is accessible from the exterior of the housing to allow the voltage regulation device 210A to be connected to other components in the power system 100. For example, the L terminal may be connected to the load 102, and the S terminal may be connected to the source 101. The L and S terminal names are simply a matter of convention. Dynamic system conditions may cause power to flow from the L terminal to the S terminal or from the S terminal to the L terminal.

The voltage regulation device 210A is a "Type A" or "Straight Voltage Regulator" that includes a shunt winding 240 between the S terminal and the SL terminal and a series winding 220 between the S terminal and the L terminal. The voltage regulation device 210A also includes a switch 221 that is used to control the polarity of the voltage on the series winding 220. One side of the switch 221 is connected to the S terminal. The other side of the switch 221 may be connected to a terminal 229*a* or to a terminal 229*b*. When the switch 221 is connected to the terminal 229*b*, the voltage across the series winding 220 adds to the voltage of the shunt winding 240. When the switch 221 is connected to the terminal 229*a*, the voltage across the series winding 220 subtracts from the voltage of the shunt winding 240.

Figure 2B:
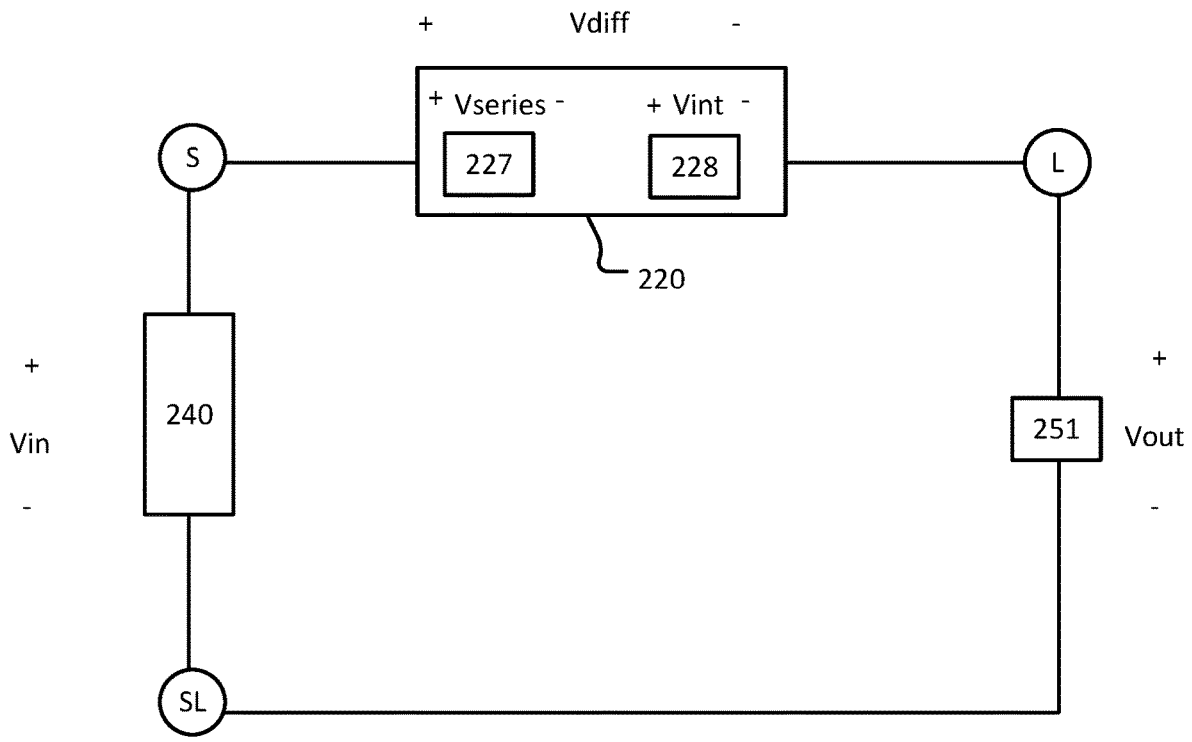
FIG. 2B is a circuit diagram of part of the voltage regulation system of FIG. 2A.

Referring also to FIG. 2B, a simplified circuit diagram of the voltage device 210A is shown. The shunt winding 240 is connected between the S and SL terminals. The voltage across the shunt winding 240 is referred to as the input voltage (Vin). The series winding 220 is connected between the S and L terminals. The voltage across the series winding 220 is referred to as the differential voltage (Vdiff). The output voltage (Vout) is the voltage between the L and SL terminals. According to Kirchoff's law, the sum of Vin, Vout, and Vdiff is equal to zero. In the implementation shown in FIG. 2A, the differential voltage (Vdiff) is measured directly by a voltage sensor 252 and an indication of the measured voltage is provided to the control system 260.

Figure 2C:
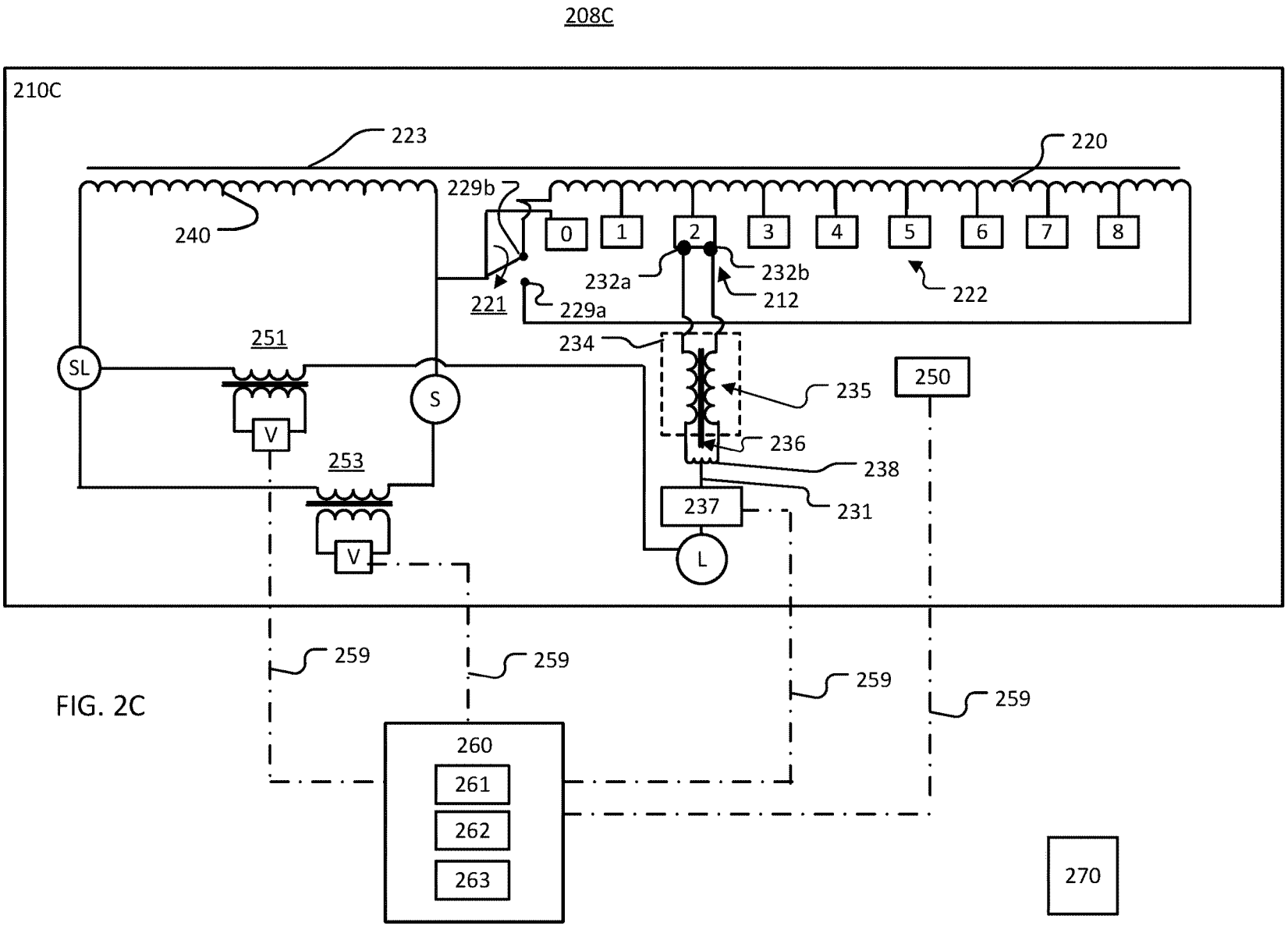

FIG. 2C is a schematic diagram of another voltage regulation system 208C. The voltage regulation system 208C is the same as the voltage regulation system 208A, except the voltage regulation system 208C does not include the voltage sensor 252 between the S and L terminals. Instead, the voltage regulation system 208C includes a voltage sensor 253 between the S and SL terminals. The voltage sensor 253 is coupled to the control system 260 and provides an indication of the voltage between the S and SL terminals of the voltage regulation device 210C. In the implementation shown in FIG. 2C, the differential voltage (Vdiff) is determined from measured values of Vin and Vout based on Kirchoff's law.

Referring again to FIG. 2A, each of the shunt winding 240 and the series winding 220 are made of an electrically conductive material, such as a metal. The shunt winding 240 and the series winding 220 are wound around a magnetic core 223. Each of the wound shunt winding 240 and the series winding 220 may form, for example, a helix. Each portion of the winding 220 or the winding 240 that encircles the core 223 is referred to as a turn. The series winding 220 has M turns, where M is an integer number that is greater than one. The shunt winding 240 has N turns, where N is an integer number that is greater than one. M and N may be the same or different values. In other words, the shunt winding 240 and the series winding 220 may have different numbers of turns.

The magnetic core 223 is made of a ferromagnetic material, such as, for example, iron or steel. The magnetic core 223 may be a gapped core or an un-gapped core. In implementations in which the core 223 is an un-gapped core, the core 223 is a contiguous segment of ferromagnetic material. A gapped core includes a gap that is not ferromagnetic material. The gap may be, for example, air, nylon, or any other material that is not ferromagnetic. Thus, in implementations in which the core 223 is a gapped core, the core includes at least one segment of a ferromagnetic material and at least one segment of a material that is not a ferromagnetic material.

The shunt winding 240 is electrically connected to the S terminal, which receives electricity from the source 101 via the distribution path 106. When the S terminal receives electricity, the shunt winding 240 is energized and a time-varying (AC) current flows in the shunt winding 240. The shunt winding 240 and the series winding 220 are magnetically coupled by the core 223. Thus, when the AC current flows in the shunt winding 240, a corresponding time-varying current is induced in the series winding 220.

The series winding 220 includes T taps 222, where T is an integer number that is greater than one. In the example of FIG. 2A, the series winding 220 includes eight taps that are labeled as tap 1, 2, 3, 4, 5, 6, 7, and 8. The series winding 220 also includes a neutral tap, which is labeled as 0. The taps 0 to 8 are collectively referred to as the taps 222. The taps 222 are made of an electrically conductive material (such as, for example, metal), and the taps 222 are electrically connected to the series winding 220. Each tap is separated from the nearest other tap, with at least one of the M turns being between any two adjacent taps 222. In the example of FIG. 2A, there are four turns between any two adjacent taps (for example, there are four turns between the tap 1 and the tap 2). Other implementations are possible. For example, more or fewer turns may be between two adjacent taps. The series winding 220 may include more or fewer taps.

The voltage regulation system 208A also includes a tap changing mechanism 212. The tap changing mechanism 212 includes movable contacts 232*a,b*, each of which are made of an electrically conductive material. Each of the movable contacts 232*a,b* is electrically connected to an electromagnetic circuit 234, which is a reactor or a preventative autotransformer. In the example of FIG. 2A, the electromagnetic circuit 234 includes two coils 235 that are wound around a common core 236. The contact 232*a* is electrically connected to one of the coils 235, and the contact 232*b* is electrically connected to the other of the coils 235. The coils 235 are also electrically connected to the L terminal at a terminal 231. In the example of FIG. 2A, the coils 235 of the electromagnetic circuit 234 are electrically connected to the terminal 231 via an equalizer winding 238. The equalizer winding 238 is a wound coil with E turns, where E is an integer number greater than 1. Although the implementation shown in FIG. 2A includes the equalizer winding 238, the coils 235 may be connected to the terminal 231 without the equalizer winding 238. In other words, the voltage regulation device 210A may be implemented without the equalizer winding 238.

The voltage at the terminal 231 (and thus at the L terminal) is determined by which one or two of the taps 222 is selected by (in electrical contact with) the electrical contacts 232*a,b*. A driving system 250 controls the motion and position of the electrical contacts 232*a,b*. Thus, the driving system 250 is used to select which of the taps 222 are in electrical contact with the contacts 232*a,b*. The driving system 250 may include, for example, mechanical linkages and motors that are used to move either or both of the moveable contacts 232 to a particular one of the taps 222. The driving system 250 is shown as being physically separated from the movable contacts 232*a,b*, but may be implemented to be mechanically coupled to the movable contacts 232*a,b* or to a device that is mechanically coupled to the movable contacts 232*a,b*. The driving system 250 is coupled to the control system 260 via a data link 259 such that the control system 260 is able to provide commands and instructions to the driving system 250.

When both of the electrical contacts 232*a,b* are in electrical contact with one of the taps 222, the tap position is a non-bridging position. In the example of FIG. 2A, the electrical contacts 232*a,b* are both on the tap labeled 2. Thus, the example of FIG. 2A shows a non-bridging position. When one of the electrical contacts 232*a,b* is in electrical contact with one of the taps 222 and the other of the electrical contacts 232*a,b* is in electrical contact with an adjacent one of the taps 222, the tap position is a bridging position. In a bridging tap position, a voltage difference between the two adjacent taps 222 drives a circulating current that flows in the coils 235 and the equalizer winding 238, and the voltage at the terminal 231 is half way between the voltage at each of the connected taps 222. In a non-bridging tap position, the electrical contacts 232*a,b* are connected to the same tap, there is no voltage difference between the electrical contacts 232*a,b*, and the voltage at the terminal 231 is the voltage of the connected tap.

The voltage regulation device 210A makes a step or a tap change each time one of the electrical contacts 232*a,b* is removed from its current tap and placed into electrical contact with an adjacent tap. In other words, a step is an actuation from one acceptable steady state tap position to an adjacent steady state tap position. In the voltage regulation device 210A, there are nine taps 222 and a total of 33 steady state positions, including the neutral position. The 33 steady state positions include 16 raise positions (1R, 2R, 3R . . . 16R), 16 lower positions (1L, 2L, 3L, . . . 16L), and the neutral position. When one of the electrical contacts 232*a* or 232*b* is disconnected from the taps 222 (for example, during a step operation or actuation), the voltage regulation device 210A does not have a valid tap position and the tap position is not in any of the 33 possible steady-state tap positions.

As discussed above, the switch 221 controls the polarity of the series winding 220. When the switch 221 is in contact with the terminal 229*b* (as shown in FIG. 2A), the voltage of the series winding 220 is added to the voltage of the shunt winding 240. When the voltage regulation system 208A is in this configuration, the tap position is referred to as a numerical value that represents the number of voltage steps away from neutral followed by "raise" or "R." In the example of FIG. 2A, the tap 2 is in contact with the electrical contacts 232*a,b*, and the switch 221 is in contact with the terminal 229*b*. Thus, the tap position is 4R. The steady-state tap positions adjacent to 4R are the tap positions 3R and 5R. To change to the tap position 3R, the electrical contact 232*b* remains in contact with the tap 2 and the electrical contact 232*a* is removed from the tap 2 and connected to the tap 1. To change to the tap position 5R from the position 4R, the electrical contact 232*b* is removed from the tap 2 and moved to the tap 3, and the electrical contact 232*a* remains in contact with the tap 2.

When the switch 221 is in contact with the terminal 229*a*, the voltage of the series winding 220 is subtracted from the voltage of the shunt winding 240. The tap position is referred to by a numerical value that represents the number of voltage steps away from neutral followed by as "lower" or "L" in this configuration. Thus, if the switch 221 was in contact with the terminal 229*a* and the electrical contacts 232*a,b* were in contact with the tap 2 as shown, the tap position would be 14L. The steady state tap positions adjacent to the tap position 14L are 13L and 15L. To change to the 13L tap position, the electrical contact 232*b* is removed from the tap 2 and connected to the tap 3, and the electrical contact 232*a* remains connected to the tap 2. To change to the 15L tap position, the electrical contact 232*a* is removed from the tap 2 and connected to the tap 1.

When the electrical contact 232 is in contact with the tap 0, there is no voltage difference between the S and L terminals, and the series winding does not add or subtract voltage to the voltage of the shunt winding 240.

When one or more of the moveable contacts 232*a,b* is in electrical contact with one or more of the taps 222, the electromagnetic circuit 234 electrically connects the series winding 220 to the L terminal via the terminal 231. As discussed above, the series winding 220 includes M turns. The number of the M turns through which current flows is M', which is determined by which of the taps 222 is in contact with the moveable contacts 232*a,b*. When the contacts 232*a* and 232*b* are connected to the taps 222, load current flows through the terminal 231 and a voltage is applied to the L terminal. The amount of voltage provided to the L terminal also depends on which tap or which two of the taps 222 is engaged to the movable contacts 232*a,b*. In the example of FIG. 2A, the tap position is 4R, and the contacts 232*a, b* are both in contact with the tap 2. Four turns are between each of the taps 122. As such, in the example of FIG. 2A, M' is eight. For a bridging tap position, M' is an average of the turns included by the contact 232*a* and the contact 232*b*, according to Equation (1):

$$M' = \left(\frac{m1' + m2'}{2}\right); \qquad \text{Equation (1)}$$

where m1' is the number of turns on the series winding 220 that are between the neutral tap and the electrical contact 232*a*, and m2' is the number of turns on the series winding 220 that are between the neutral contact and the electrical contact 232*b*.

Referring also to FIG. 2B, the differential voltage (Vdiff) is the measured voltage of the portion of the series winding 220 connected in the circuit between the S and L bushings. The differential voltage (Vdiff) is given by Equation (2):

$$Vdiff = Vseries + Vinternal \qquad \text{Equation (2);}$$

where Vseries is the induced voltage on the M' turns (labeled 227 in FIG. 2B) and Vint is the voltage across a modeled internal impedance 228. The internal impedance 228 is a characteristic of the series winding 220, and the internal impedance 228 depends on the position of the tap changing mechanism 212 and structural characteristics of the series winding 220. The internal impedance 228 is discussed further with respect to FIG. 3.

A current sensor 237 measures the load current that flows in the terminal 231. The current sensor 237 may be, for example, a current transformer (CT). The current sensor 237 is connected to provides data that indicates the amount of the load current to the control system 260 through the data link 259. In addition to the current sensor 237, the voltage regulator system 208A also includes a voltage sensor 251 between the L terminal and the SL terminal, and a voltage sensor 252 between the L terminal and the S terminal. The voltage sensors 251, 252 provide data that indicates the amount of sensed voltage to the control system 260. The voltage sensor 251 senses the output voltage of the voltage regulation device 210A (labeled Vout in FIG. 2B). The voltage sensor 252 senses Vdiff (which is the voltage difference between the S terminal and the L terminal). In the example of FIG. 2A, each of the voltage sensors 251, 252 is a potential transformer (PT). However, any device capable of producing an indication of the voltage between two terminals or nodes may be used. Further, Vdiff can be measured directly as in the implementation shown in FIGS. 2A and 2B or calculated from two or more measurements as in FIG. 2C.

The voltage regulation system 208A also includes the control system 260, which includes an electronic processing module 261, an electronic storage 262, and an input/output (I/O) interface 263. The electronic processing module 261 includes one or more electronic processors. The electronic processors of the module 261 may be any type of electronic processor and may or may not include a general purpose central processing unit (CPU), a graphics processing unit (GPU), a microcontroller, a field-programmable gate array (FPGA), Complex Programmable Logic Device (CPLD), and/or an application-specific integrated circuit (ASIC).

The electronic storage 262 may be any type of electronic memory that is capable of storing data and instructions in the form of computer programs or software, and the electronic storage 262 may include volatile and/or non-volatile components. The electronic storage 262 and the processing module 261 are coupled such that the processing module 261 is able to access or read data from and write data to the electronic storage 262.

The I/O interface 263 may be any interface that allows a human operator and/or an autonomous process to interact with the control system 260. The I/O interface 263 may include, for example, a display (such as a liquid crystal display (LCD)), a keyboard, audio input and/or output (such as speakers and/or a microphone), visual output (such as lights, light emitting diodes (LED)) that are in addition to or instead of the display, serial or parallel port, a Universal Serial Bus (USB) connection, and/or any type of network interface, such as, for example, Ethernet. The I/O interface 263 also may allow communication without physical contact through, for example, an IEEE 802.11, Bluetooth, or a near-field communication (NFC) connection. The control system 260 may be, for example, operated, configured, modified, or updated through the I/O interface 263.

The I/O interface 263 also may allow the control system 260 to communicate with systems external to and remote from the system 208A. For example, the I/O interface 263 may include a communications interface that allows communication between the control system 260 and a remote station 270, or between the control system 260 and a separate electrical apparatus in the power system 100 (FIG. 1) other than the voltage regulation device 210A using, for example, the Supervisory Control and Data Acquisition (SCADA) protocol or another services protocol, such as Secure Shell (SSH) or the Hypertext Transfer Protocol (HTTP). The remote station 270 may be any type of station through which an operator is able to communicate with the control system 260 without making physical contact with the control system 260. For example, the remote station may be a computer-based work station, a smart phone, tablet, or a laptop computer that connects to the control system 260 via a services protocol, or a remote control that connects to the control system 260 via a radio-frequency signal. The control system 260 may communicate information such as the determined tap position through the I/O interface 263 to the remote station 270 or to a separate electrical apparatus.

Figure 3:
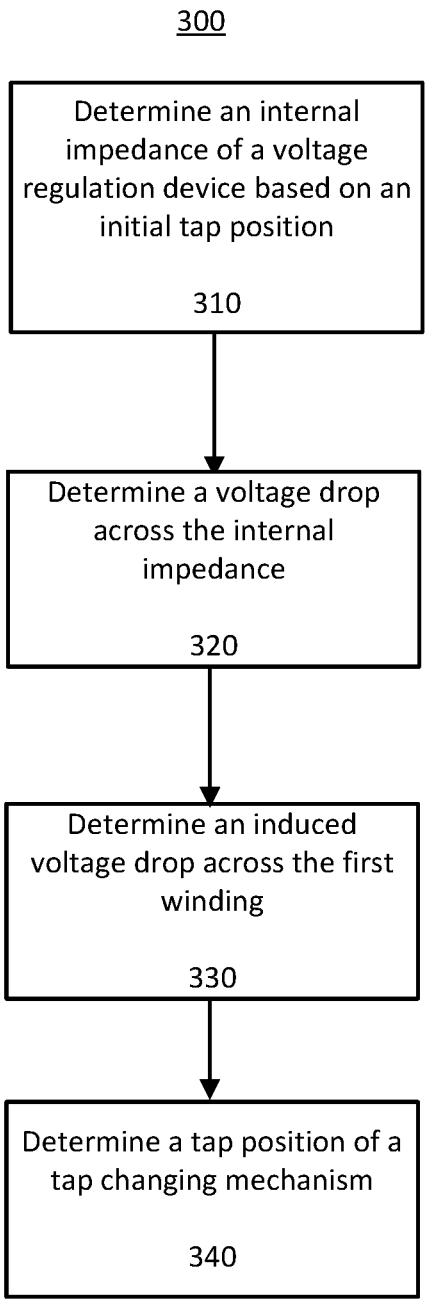
FIGS. 3-6 are flow charts of examples of processes that relate to determining a tap position.

Referring to FIG. 3, a flow chart of a process 300 is shown. The process 300 is an example of a process for determining a tap position of a voltage regulation system. The process 300 may be performed by one or more electronic processors in the processing module 261 of the control system 260 (FIGS. 2A and 2C), and the process 300 is discussed with respect to the voltage regulation systems 208A (FIGS. 2A and 2B) and 208C (FIG. 2C). However, the process 300 may be performed by other control systems that control different configurations and types of voltage regulation systems.

The internal impedance 228 of the series winding 220 is determined based on an initial position of the tap changing mechanism 212 (310). The initial tap position is an indication of which one or two of the taps 222 are in electrical contact with the contacts 232*a,b*. The indication may be, for example, a numerical value. The initial position of the tap changing mechanism 212 may be a position that is generated by a traditional tap position tracking technique and stored on the electronic storage 262. For example, the initial position may be a position that determined by counting the number of times the driving system 250 was excited over a period of time that occurred prior to initiating the process 300. In another example, the initial tap position may be a position that is assumed based on one or more operating parameters of the voltage regulation system 208A or 208C. In yet another example, the initial tap position may be a position that is entered by the operator using the I/O system 263.

The internal impedance 228 of the voltage regulation device 110 is the inherent impedance of the series winding 220 and its interaction with the core 223 and shunt winding 240. The internal impedance 228 depends on the geometry (for example, the shape and size) of the series winding 220 and the material or materials present in the series winding 220 as well as its proximity and orientation to the core 223 and shunt winding 240. The internal impedance 228 also depends on the tap changer position and the number of active turns in the series winding, M'. Thus, the internal impedance 228 is a value that varies during operation of the voltage regulating device 110 and is calculated, estimated, or retrieved based on the initial tap position.

Information about the internal impedance 228 may be stored on the electronic storage 262 at the time that the voltage regulation system 208A or 208C is manufactured and/or may be provided to the control system 260 after manufacturing via the I/O interface 263. The information about the internal impedance 228 includes internal impedance values as a function of tap changer position. For example, one internal impedance value may be associated with the each raise tap position (the positions when the switch 221 is connected to the terminal 229*a*) and each lower tap position (when the switch 221 is connected to the terminal 229*b*). In other words, the information about the internal impedance 228 may include an impedance value for each possible raise and lower tap position of the voltage regulation system 210A.

The internal impedance value associated with each tap position may be, for example, a complex number that includes a real component due to the circuit resistance (in units of Ohms) and an imaginary component that represents reactance due to the circuit inductance (in units of Henries) and/or capacitance (in units of Farads). Each complex number represents the impedance of the device for a given portion of the series winding 220 in the circuit when a particular one of the taps 222 is in contact with both of the electrical contacts 232*a,b* or when a particular two adjacent taps 222 are each in contact with one of the electrical contacts 232*a,b* and accounting for the state of the switch 221.

In some implementations, the internal impedance values are determined by measuring the impedance of the device at more than one tap position and using the measured values to determine estimates of the impedance of the device for other tap positions. For example, the spatial impedance values in the database or look-up table may be estimated by measuring the impedance of the device in four different tap positions and using interpolation to estimate the impedance for other tap positions. The interpolation may be based on knowledge of the geometry of the series winding 220. For example, the impedance of a particular configuration of the series winding 220 may be known to vary with the square of M (the number of turns in the series winding 220), linearly, or in some other manner, and the interpolation between the measured points is selected to produce estimates that vary in the same manner.

The value of the internal impedance 228 is determined based on the initial tap position. For example, if the initial tap position is 6R, the control system 260 determines that the internal impedance 228 has the value that is associated with the internal impedance of the series winding 220 when tap 3 is in contact with the electrical contacts 232*a,b* and the switch 221 is in contact with the terminal 229*b*.

The voltage drop across the internal impedance 228 is determined (320). This voltage drop is labeled (Vint) in FIG. 2B. The voltage drop across the internal impedance 228 is determined by phasor multiplying two complex numbers: the internal impedance value determined in (310) by the load current measured by the current sensor 237 (FIGS. 2A and 2C).

The determined voltage drop (Vint) is used to determine the induced voltage (Vseries) on the portion of the series winding 220 in the circuit. As discussed with respect to Equation (2) and as shown in FIG. 2B, the differential voltage (Vdiff) is equal to the voltage drop across the internal impedance (Vint) determined in (320) added to the induced voltage (Vseries) on the series winding 220. The control system 260 receives a measurement of the differential voltage (Vdiff) or determines the differential voltage (Vdiff) based on other received measured values. For example, in the voltage regulation system 208A (FIG. 2A), the differential voltage is measured by the voltage sensor 252. The value measured by the voltage sensor 252 is provided to the control system 260. In the voltage regulation system 208C (FIG. 2C), the voltages measured by the voltage sensors 251 and 253 are used to determine the differential voltage. In this implementation, the differential voltage is determined by subtracting the voltage measured by the voltage sensor 253 (the voltage difference between the S and SL terminals) from the voltage measured by the voltage sensor 251 (the voltage difference between the L and SL terminals).

Thus, the differential voltage (Vdiff) and the voltage (Vint) on the internal impedance 228 are known, and the induced voltage (Vseries) on the series winding 220 is determined by subtracting the voltage (Vint) from the differential voltage (Vdiff). In this manner, the induced voltage (Vseries) across the series winding 220 is determined (330).

Using the induced voltage (Vseries), the actual position of the tap changing mechanism is determined as follows. The induced voltage (Vseries) of the series winding 220 is related to the voltage on the shunt winding 240 according to Equation (3):

$$V_{series} = \frac{M'}{N}(V_{shunt}); \qquad \text{Equation (3)}$$

where $V_{series}$ is the induced voltage on the series winding 220, M' is the number of turns on the series winding 220 through which current is flowing, N is the number of turns on the shunt winding 240, and $V_{shunt}$ is the voltage on the shunt winding 240.

Equation (3) is solved for M' to determine the tap position. The voltage on the shunt winding 240 (Vshunt) is measured or derived from measured voltages. For example, in the voltage regulation device 210C (FIG. 2C), the voltage on the shunt winding 240 (Vshunt) is the voltage measured by the voltage sensor 253. In the voltage regulation device 210A, the voltage on the shunt winding 240 (Vshunt) is the load voltage measured by the voltage sensor 251 minus the differential voltage measured by the voltage sensor 252. The shunt winding 240 is not tapped, thus the value of N remains constant during operation. However, the series winding 220 is tapped, and M' varies during operating depending on which of the taps 222 are in contact with the moving contacts 232*a,b*. The value of N is known, the induced voltage (Vseries) is determined from (330), and the voltage on the shunt winding 240 (Vshunt) is measured. Accordingly, Equation 3 may be solved for M' to produce a determined value of M'.

The tap position is determined (340). For example, the tap position may be determined from the value of M'. In some implementations, a look-up table or database is used to determine the tap position. In these implementations, the look-up table or database includes the number of turns of the series winding 220 that are known to be in the circuit between the S and L terminals for each of the possible tap positions of the voltage regulation device 210A. In these implementations, the determined value of M' is compared to the known number of turns stored in the table or database to find the known number of turns that is closest to M'. The tap position in the table or database that corresponds to the known number of turns closest to M' is the determined tap position, taking into account the position of the switch 221 to determine whether the tap position is a raise position or a lower position.

In another example the tap position may be calculated based on M' without using a look-up table. For example, the number of turns between each adjacent tap 222 is known. By dividing the determined value of M' by the number of turns between each adjacent tap, an estimated tap number is calculated. If the tap position is a non-bridging tap position, then the estimated tap number is the tap position, with the tap position being a raise position if the switch 221 is connected to the terminal 229*b* and a lower position if the switch 221 is connected to the terminal 229*a*. If the determined value of M' divided by the number of turns between each adjacent tap is more than a threshold amount different than the turns associated with the nearest non-bridging tap position, then the tap position is determined to be the non-bridging tap position that has the number of turns closest to M'.

Figure 4:
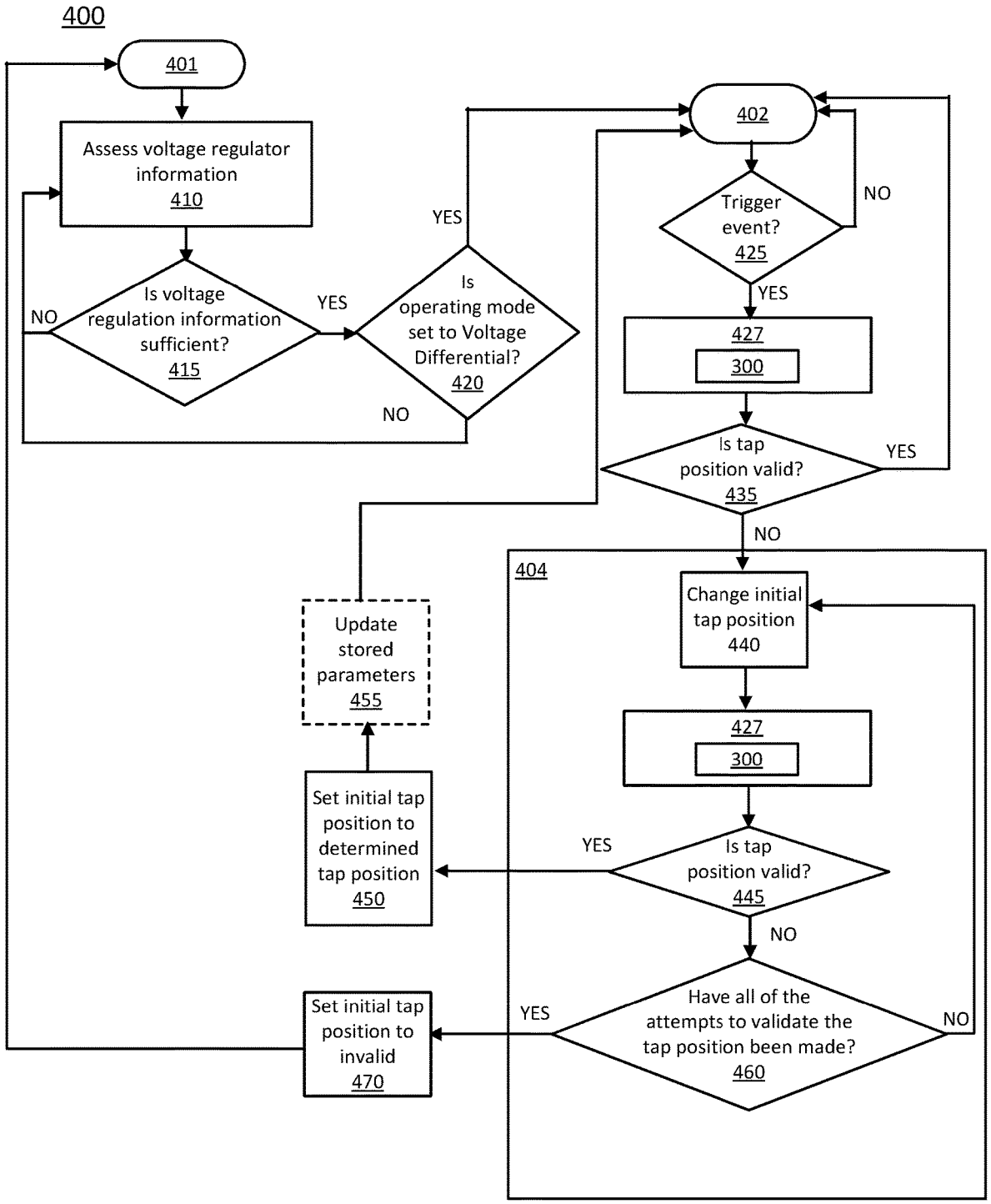

FIG. 4 is a flow chart of a process 400. The process 400 is an example of a process that may be used with the process 300 (FIG. 3). For example, the process 400 may be used to verify that the initial tap position is a valid tap position. The process 400 also may be used to determine a valid tap position if the initial tap position is not valid. The process 400 may be performed by one or more electronic processors of the processing module 261 of the control system 260. The process 400 is discussed with respect to FIGS. 2A, 2B, and FIG. 3, and the voltage regulation system 208A.

Initially, the control system 260 is in a first state 401. When the control system 260 is in the first state 401, the control system 260 is not ready to perform the process 300. The first state 401 is also referred to as the not ready state.

In preparation for possibly performing the process 300, information about the voltage regulation system 208A is assessed (410). The information includes determining whether the control system 260 has access to data that represents a measured value of the differential voltage (Vdiff) and/or other measured data from the voltage regulation device 210A (such as the load current data from the sensor 237), determining whether the initial tap position is usable, and determining whether the data about the voltage regulator is usable. Assessing the information to ensure that the information is usable includes determining whether the information exists and whether the information is suitable for use in the process 300.

Under typical operating conditions, the control system 260 receives measured data that represents the differential voltage (Vdiff) from the voltage sensor 252 and measured data that represents the load current from the sensor 237 (FIG. 2A). However, if the voltage sensor 252 (or the sensor 237) is malfunctioning or damaged, the control system 260 does not receive the measurement data or receives incorrect and/or unusable measurement data. Such data is assessed as unusable.

Assessing the information also includes determining whether the initial tap position exists and whether the initial tap position is a usable value. For example, the initial tap position is a usable value when the value corresponds to one of the 33 possible tap positions available in the voltage regulation device 210A. If the value corresponds to a tap position that does not exist in the voltage regulation device 210A, then the initial tap position is not usable.

Furthermore, information related to the voltage regulation system 208A is assessed. For example, if information about the internal impedance 228 (such as a look-up table that includes impedance values as a function of position along the series winding 220 and/or a mathematical relationship that enables estimation of impedance values) is not stored on the electronic storage 262 or on another electronic storage that is accessible to the processing module 261, then the data related to the voltage regulation 208A is assessed as being insufficient or unusable. Additionally, other information about the voltage regulation system 208A, such as whether the voltage regulator is a Type A regulator or a Type B regulator, is assessed.

It is determined if the information about the voltage regulation system 208A is sufficient for use in the process 300 (415). If any of the information about the voltage regulation system 208A is missing or otherwise unsuitable for use in the process 300, the control system 260 remains in the first state 401. The control system 260 may continue to assess the information about the voltage regulation system 208A (410), may attempt to obtain missing information by providing alerts to an operator, or may end the process 400.

If the information about the voltage regulation system 208A is assessed to be sufficient for use in the process 300, the operating mode of the control system 260 is determined. The control system 260 has more than one operating mode, and the operating mode may be selected by the operator through the I/O interface 263. The selected operating mode is assigned an indicator (for example, a particular numerical value that is associated with a particular operating mode) and is stored in the electronic storage 262. The control system 260 determines the operating mode by analyzing the stored indicator.

In the example of FIG. 4, the control system 260 has a first operating mode in which the process 300 is never performed and a second operating mode in which the process 300 may be performed if the information about the voltage regulation system 208A is determined to be sufficient in (415). In the first operating mode, the control system 260 may rely on, for example, traditional techniques for estimating the tap position. In the second operating mode (which is also referred to as the voltage differential mode) the control system 260 uses the process 300 to verify and/or validate an initial tap position (which may be generated by a traditional process) or a determined tap position (generated by the process 300) and to iterate around the initial tap position to determine the actual tap position. As discussed above, the tap position determined by a traditional process may be inaccurate. Thus, the process 400 provides a technique to improve upon the initial tap position in an efficient manner by determining whether a tap position is valid and can be used by external devices and processes that depend on tap position or if the tap position should be updated or ignored.

If it is determined that the control system 260 is in the voltage differential mode, then the control system 260 is placed in a ready state 402. When in the ready state 402, the control system 260 may perform the process 300.

The control system 260 determines whether a trigger event that indicates that the process 300 should be run has occurred (425). The trigger event may be based on data received by the control system 260. For example, the control system 260 may continue to perform aspects of the assessment (410) while in the ready state 402. Thus, the control system 260 may receive a new and different initial tap position in the ready state 402. Receiving a new initial tap position is a trigger event. In another example, the trigger event may be a measurement that indicates that the differential voltage (Vdiff) increased or decreased by more than a threshold amount. In these implementations, the threshold voltage amount and historical differential voltage (Vdiff) measurements from the voltage sensor 252 are stored on the electronic storage 262. A change in the differential voltage (Vdiff) over a time period is calculated and compared to the threshold amount. If the calculated change exceeds the threshold amount, a trigger event exists and the process 300 is performed. The threshold voltage amount may be, for example, an amount of voltage (such as, for example, 0.4 Volts) or an indication of a relative decrease or increase compared to past measurements.

In yet another example, the trigger event may be based on a metric that is monitored by the control system 260. For example the control system 260 may include timers that track the amount of time that has elapsed since the control system 260 entered the ready state 402 and/or the amount of time since the process 300 has been performed. In these implementations, a threshold time is stored in the electronic storage 262 and the elapsed time is compared to the threshold time to determine whether a trigger event has occurred. The trigger event is determined to have occurred when the elapsed time exceeds the threshold time. For example, the threshold time may be set such that the process 300 is performed every 15 minutes while the control system 260 is in the ready state 402.

If a trigger event is determined to have occurred at (425), then the initial tap position is provided to a module 427 that performs the process 300 (427). As discussed above with respect to FIG. 3, the process 300 determines a tap position or an indication of the tap position (a value such as the number of turns M') using the initial tap position. After the process 300 is performed, the validity of the initial tap position is assessed (435). The initial tap position is valid if the initial tap position is equal to or differs from the determined tap position by no more than a threshold amount. Assessing the validity of the initial tap position may include comparing the initial tap position to the determined tap position. For example, if the initial tap position is 3L and the determined tap position is 4L, the comparison reveals that the initial tap position and the determined tap position are not the same, and the initial tap position may be determined to be invalid. Assessing the validity of the initial tap position may include comparing values associated with the tap position, for example, values from which the tap position may be derived. For example, assessing the validity of the initial tap position may include determining a difference between the known number of turns associated with the initial tap position and the number of turns (M') determined at (330) discussed with respect to FIG. 3.

In some implementations, the absolute value of the difference is compared to a threshold that is stored on the electronic storage 262. In these implementations, the initial tap position is valid if the absolute value of the difference is less than the threshold, and the initial tap position is not valid if the absolute value of the difference is greater than or equal to the threshold. The threshold may be any value that is greater than or equal to zero. In implementations in which the threshold is zero, the initial tap position is valid when the initial tap position is the same as the determined tap position.

In some implementations, comparing the initial tap position to the determined tap position includes determining the difference between the initial tap position and the determined tap position and comparing the difference to a range of values. In this implementation, the initial tap position is valid if the difference is within the range of values. The range of values may include positive and negative values, and zero and the absolute value of the difference is not computed prior to performing the comparison. The range of values may be centered on zero, but this is not necessarily the case. In these implementations, the initial tap position is valid when the difference is within the range of values.

Other implementations of the comparison are possible and the above implementations are provided as examples.

If the initial tap position is valid, the determined tap position or the initial tap position may be provided to and used by external devices and processes that rely on knowledge of the tap position of the voltage regulation device 208A. The control system 260 remains in the state 402 and monitors for the next trigger event.

If the initial tap position is not valid, it is likely that the initial tap position is incorrect and the process 400 initiates a sub-process 400 that iteratively searches for a valid tap position. The initial tap position is changed (440) and the process 300 is performed again but with the changed tap position as the input instead of the initial tap position. The number of times that the process 300 is performed in the sub-function 404 is governed by rules stored on the electronic storage 262. For example, the rules may indicate that the process 300 should be performed no more than a threshold number of times. In these implementation, a voltage differential process counter is used to track how many times the process 300 has been performed since the occurrence of the trigger event. The voltage differential counter is initialized to zero when the sub-process 404 is initiated, and the voltage differential counter is increased by one each time the sub-process invokes the process 300. When the value of the voltage differential counter equals the value of the maximum number of attempts stored on the electronic storage 262, all of the attempts to validate the initial tap position have been made.

In some implementations, the rules include information about how to change the initial tap position and how many times to perform the process 300. For example, the rules may indicate that the initial tap position should first be increased from its original value by one, then be decreased from its original value by one, then increased from its original value by two, then be decreased from its original value by two, and finally increased from its original value by three and then decreased from its original value by three, with the process 300 being performed each time the value of the initial tap position is changed. In this implementation, the initial tap position value is increased three times and decreased three times. Thus, if the initial tap position value is 4L, the initial tap position value begins at 4L and is changed in the following sequence: 5L, 3L, 6L, 2L, 7L, and 1L. Thus, up to seven attempts may be made to validate the initial tap position, with each attempt using a value of the initial tap position that is indicated by the rules. Continuing with this example, the initial tap position is increased by 1 at (440). For example, the initial tap position is a numerical value (ipt), and the changed initial tap position is ipt+1. The changed initial tap position (ipt+1) is used by the process 300 to determine a new determined tap position (427). The changed initial tap position is assessed for validity (445). The changed initial tap position is assessed for validity in a manner similar to that discussed with respect to (435). That is, the determined initial tap position is compared to the changed initial tap position (ipt+1) by determining the difference between the new determined tap position and the changed initial tap position or by determine a difference between a value associated with the initial tap position and the determined tap position. The difference is compared to a value or a range of values to determine whether the new determined tap position is valid.

If the changed initial tap position is valid, the initial tap position is set to the changed initial tap position (450). Additionally, in some implementations, other parameters on the electronic storage 262 are updated (455). For example, a sequence of events (SOE) file or record may be updated to indicate that the original initial tap position was not valid, but the changed initial tap position was valid. The process 400 remains in the ready state 402 and continues to monitor for the occurrence of a trigger event.

If the changed initial tap position is not valid and if all of the attempts have not been made (460), the initial tap position is changed again (440), and the process 300 is performed again. As discussed above, the control system 260 includes rules that govern how the initial tap position is changed and how many times the sub-process 404 is able to invoke the process 300. The voltage differential counter may be used to track the number of times the sub-process 404 has invoked the process 300. In some implementations, the changes made to the initial tap position value are tracked and the process 300 performed with all of the possible values of the initial tap position value.

If the changed initial tap position is not valid and if all of the attempts have been made (406), the initial tap position is set to invalid (465). The initial tap position being set to invalid indicates that the initial tap position is not accurate, could not be corrected, and the tap position should not be used. In some implementations, the control system 260 produces a perceivable alert regarding the initial tap position being invalid. For example, the control system 260 may produce an audible sound or a visual alert (such as flashing lights). In another example, the control system 260 may provide the alert to a remote system by, for example, sending an e-mail or text message to a computer that is in communication with the I/O interface 263.

In the example of FIG. 4, the process 400 returns to the not ready state (the first state) 401 after the initial tap position is determined to be invalid. Other implementations are possible. For example, in some implementations, the process 400 ends after the initial tap position is determined to be invalid and does not resume until the voltage regulation device 208A is manually inspected by an operator.

Figure 5:
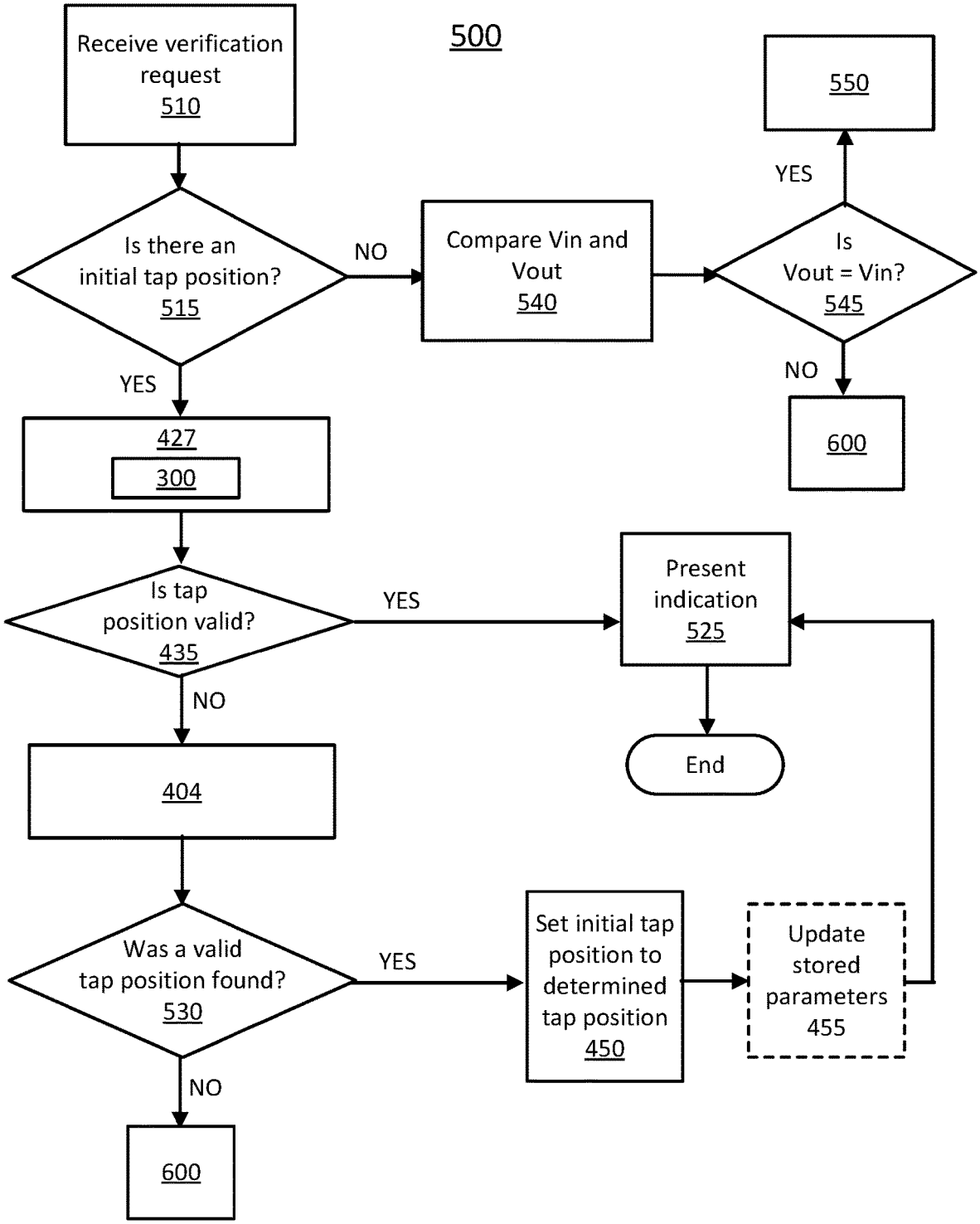

FIG. 5 is a flow chart of a process 500 that performs a check or verification of a tap position. As discussed above, the accuracy of the tap position may be important for the proper functioning of the power system 100. Thus, the process 500 may improve the performance of the power system 100. The process 500 is another example of a process that uses the process 300. Additionally, the process 500 uses the sub-process 404 (FIG. 4) and other aspects of the process 400 (FIG. 4). The process 500 may be performed by one or more of the electronic processors in the processing module 261, and the process 500 is discussed with respect to the voltage regulation system 208A (FIGS. 2A and 2B).

The control system 260 receives an indication that a verification mode has been invoked (510). The verification request may be invoked by the operator of the voltage regulation system 208A. For example, the operator of the system 208A may use the I/O interface 263 to invoke the verification mode. The verification mode may be used to check an initial tap position. When the verification mode is invoked, an initial tap position is accessed. For example, the initial tap position may be stored on the electronic storage 262. The initial tap position is evaluated for availability at (515).

If the initial tap position is available, then the initial tap position is provided to the module 427, which invokes the process 300 (FIG. 3). The module 427 provides the initial tap position to the process 300, and the process 300 returns a determined tap position based on the initial tap position. The initial tap position is assessed for validity (435). As discussed above with respect to FIG. 4, the initial tap position is assessed for validity by determining a difference between the determined tap position and the initial tap position and comparing the difference to a threshold value or a range of values. Moreover, the initial tap position may be assessed for validity by determining a difference between values associated with the initial tap position and values associated with the determined tap position. For example, the determined number of turns M' may be compared to the known number of turns associated with the initial tap position.

If the initial tap position is determined to be valid, then an indication that the initial tap position is valid is generated (525). For example, the indication may be a perceivable indication. The perceivable indication is presented by the I/O interface 263. The perceivable indication may be, for example, a visual indication and/or a sound that is made at the voltage regulation system 208A. In another example, the I/O system 263 provides the perceivable indication to the remote station 270, and the indication is presented at the remote station 270. In yet another example, the indication includes information about the validated tap position, and the indication is provided to the remote station 270 and/or to another electrical apparatus in the power system 100. By providing only information about a validated tap position, the process 500 may improve the overall performance and reliability of the power system 100. The process 500 ends after the indication is generated.

On the other hand, if the initial tap position is not determined to be valid at (435), then the sub-process 404 is invoked. As discussed with respect to FIG. 4, the sub-process 404 iterates the value of the initial tap position and determines the tap positions for the different possible initial tap positions to search for a valid tap position. If a valid tap position is found by the sub-process 404, then the initial tap position is set to the tap position that was deemed to be valid (450). Additionally, other parameters of the voltage regulation system 208A may be updated (455). The perceivable indication is presented (525), and the process 500 ends.

If the sub-process 404 does not find a valid tap position (530), then a process 600 is performed. The process 600 is discussed below with respect to FIG. 6.

On the other hand, if there is no initial tap position or if the initial tap position is unusable (515), the process 500 determines whether to invoke the process 600 to find the tap position. Before invoking the process 600, the tap position is assessed to determine if the voltage regulation system 208A is in the neutral tap position. To determine whether the tap position is the neutral position, the input voltage (Vin) and the output voltage (Vout) are compared (540). If the output voltage (Vout) is greater than the input voltage (Vin), the voltage regulation system 208A is boosting, and the tap position is not the neutral position. If the output voltage (Vout) is less than the input voltage (Vin), the voltage regulation system 208A is bucking, and the tap position is not in the neutral position. If the input voltage (Vin) and the output voltage (Vout) are the same (545), then the tap position is in the neutral position and the initial tap position is set to invalid. The I/O interface 263 may produce a perceivable message related to the initial tap position being in the neutral position (550).

If the input voltage (Vin) and the output voltage (Vout) are not the same and the initial tap position is unusable or does not exist, the process 600 is performed to determine the tap position.

Figure 6:
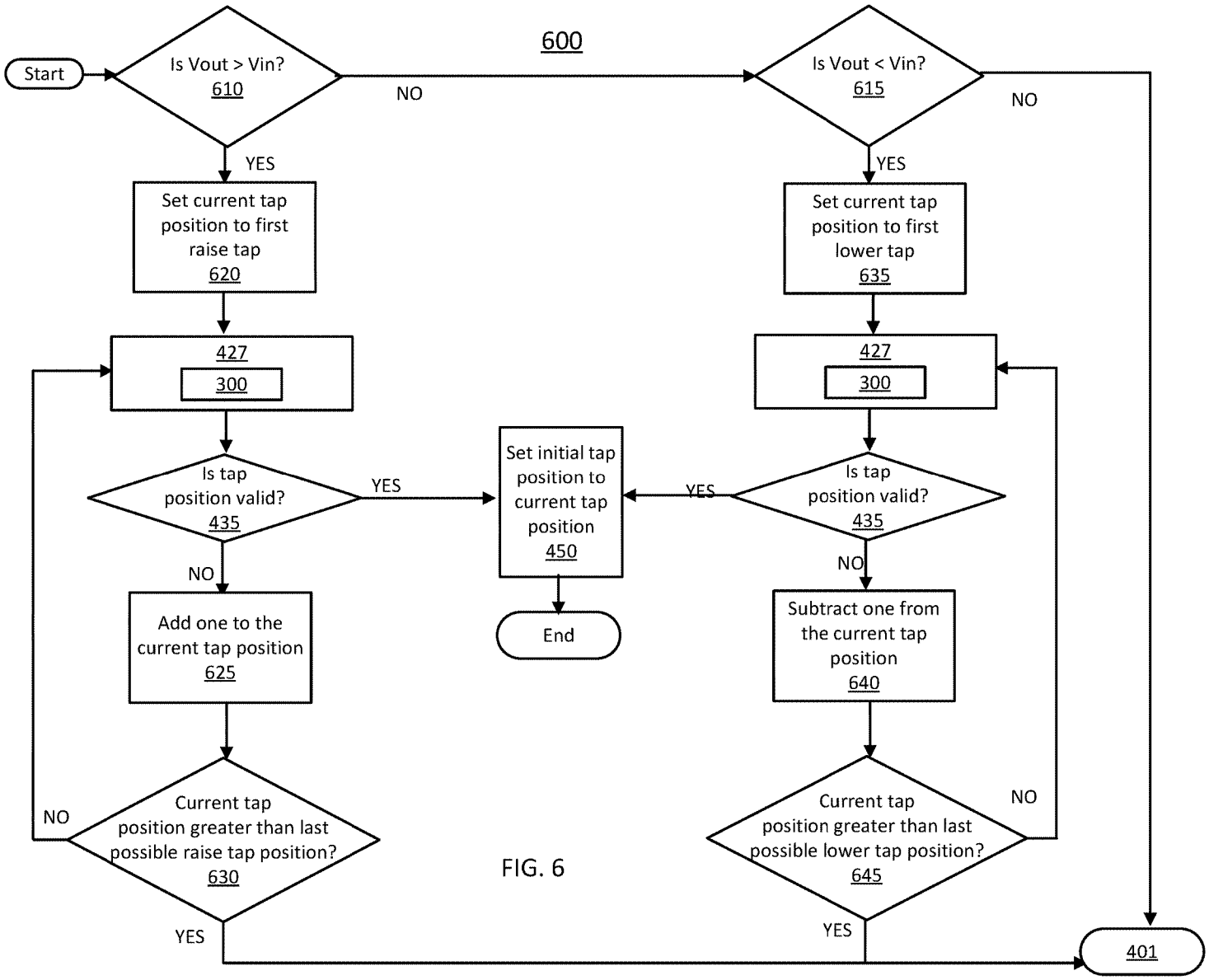

Referring to FIG. 6, a flow chart for the process 600 is shown. The process 600 may be used when no usable tap position has been determined from a traditional process or from the processes 400 and 500 discussed above. The process 600 may be performed by one or more electronic processors in the processing module 261. The process 600 is discussed with respect to the voltage regulation system 208A. The process 600 searches for a valid tap position by checking each possible tap position in the voltage regulation system 208A.

The process 600 begins by comparing the output voltage (Vout) to the input voltage (Vin). In the example of FIG. 6, it is determined whether the output voltage (Vout) is greater than the input voltage (Vin) (610). If the output voltage (Vout) is not greater than the input voltage (Vin), then it is determined whether the output voltage (Vout) is less than the input voltage (Vin) (615). If the output voltage (Vout) is not greater than or less than the input voltage (Vin), the tap position is the neutral tap, and the process 600 returns to the not ready state 401. A perceivable indication regarding the invalid initial tap position may be produced at the I/O interface 263.

At (610), if the output voltage (Vout) is greater than the input voltage (Vin), the voltage regulation system 208A is boosting. The current tap position is set to the first raise tap, which is 1R. The tap position being 1R indicates that the electrical contact 232*b* is in contact with the tap 1, the electrical contact 232*a* is in contact with the neutral tap (labeled 0), and the switch 221 is in contact with the terminal 229*b*. The last possible raise tap position is 16R, which indicates that the electrical contact 232*b* is in contact with the tap 8, the electrical contact 232*a* is in contact with tap 8, and the switch 221 is in contact with the terminal 229*b*. Next, the process 300 is performed with the current tap position as the initial tap position (427). The current tap position at this time is the 1R position. The process 300 produces a determined tap position, as discussed above with respect to FIG. 3. The current tap position is assessed for validity (435). If the current tap position is valid, then the initial tap position is set to the current tap position (450), and the process 600 ends. Additionally other parameters and metrics associated with the voltage regulation system 208A (such as a sequence of events record or file) may be updated.

If the current tap position is not valid, the current tap position is increased by one to the next raise tap position (625). Continuing with the example above in which the previous current tap position is 1R, after (625), the current tap position becomes 2R. The tap position 2R indicates that the electrical contacts 232*a,b* make contact with the tap 1 and the switch 221 is in contact with the 229*b* terminal. It is determined whether the current tap position is greater than the last possible physical tap position (630). In this example, the last possible tap position is 16R. Thus, the current tap position is less the last possible tap position, and the current tap position is provided to the module 427, which performs the process 300 using the current tap position as the initial tap position. The current tap position (2R) is assessed for validity. The sequence of increasing the current tap position by one continues until a valid tap position is found or the current tap position exceeds the last possible tap position. If a valid tap position is found, the initial tap position is set to the current tap position (450), and the process 600 ends. Additionally other parameters and metrics associated with the voltage regulation system 208A (such as a sequence of events record or file) may be updated. On the other hand, the current tap position is increased through all of the possible raise positions with no valid tap position being found and the current tap position exceeds the last possible tap position at (630), then no valid tap position was found and the process 600 returns to the not ready state 401.

If the output voltage (Vout) is less than the input voltage (Vin), the voltage regulation system 208A is in bucking mode. The current tap position is set to the first lower tap position (635). The first lower tap position on the voltage regulator 208A is 1L, which indicates that the electrical contact 232*a* is in contact with the neutral tap (tap 0), the electrical contact 232*b* is in contact with the tap 8, and the switch 221 is in contact with the terminal 229*a*. The process 300 is performed with the current tap position (1L) as the initial tap position. The current tap position is assessed for validity (435). If the current tap position is valid, then the initial tap position is set to the current tap position (450), and the process 600 ends. Additionally other parameters and metrics associated with the voltage regulation system 208A (such as a sequence of events record or file) may be updated.

If the current tap position is not valid, then the current tap position is lowered to the next lower tap position. In this example, the previous current tap position is 1L, thus the current tap position becomes 2L. The tap position 2L indicates that the contacts 232*a,b* are on the tap 8 and the switch 221 is in contact with the terminal 229*a*.

It is determined whether the current tap position is greater than the last possible physical tap position (645). In this example, the last possible tap position is 16L. Thus, the last possible tap position has not been reached and the current tap position (2L) is provided to the module 427, which performs the process 300 using the current tap position (2L) as the initial tap position. The current tap position (2L) is assessed for validity (435). The sequence of changing the current tap position by one continues until a valid tap position is found or the current tap position exceeds the last possible tap position. If a valid tap position is found, the initial tap position is set to the current tap position (450), and the process 600 ends. Additionally other parameters and metrics associated with the voltage regulation system 208A (such as a sequence of events record or file) may be updated. On the other hand, the current tap position is decreased through all of the possible lower positions with no valid tap position being found and the current tap position exceeds the last possible tap position at (645), then no valid tap position was found and the process 600 returns to the not ready state 401.

The processes 400, 500, and 600 are provided as examples of processes that use the process 300. Other implementations are possible. For example, in the process 600, whether the output voltage (Vout) is less than the input voltage (Vin) may be determined before determining whether the output voltage (Vout) is greater than the input voltage (Vin).

Other features are within the scope of the claims. For example, the techniques discussed above may be applied to configurations of voltage regulation systems and voltage regulation devices that are different than the configurations shown in FIGS. 2A and 2C. For example, the voltage regulation device 210A or the voltage regulation device 210C may be configured as a "Type B" or "Inverted Voltage Regulator" in which the shunt winding 240 is between the L terminal and SL terminals and the series winding 220 is between the S and L terminals. Furthermore, the above techniques may be applied to a voltage regulation system that is the same as the voltage regulation system 208A except the PT 251 is between the S and SL terminals and the PT 253 is between the L and SL terminals.

Additionally, the voltage regulation system 208A and 208C may be operated in a forward power mode or a reverse power mode. In the forward power mode, an input voltage is applied S and SL terminals and the output voltage is provided across the L and SL terminals. In the reverse power mode, the input voltage is applied to the L and SL terminals, and the output voltage is provided across the S and SL terminals.

What is claimed is:

1. A control system for a voltage regulation device, the control system comprising:

one or more electronic processors; and a non-transitory machine readable storage medium comprising instructions, that when executed, cause the one or more electronic processors to:

determine a value of an internal impedance of the voltage regulation device based on an initial tap position of a tap changing mechanism relative to a first winding of the voltage regulation device, wherein the value of the internal impedance of the voltage regulation device includes an impedance of the first winding that varies with a position of the tap changing mechanism relative to the first winding;

determine a voltage drop across the internal impedance based on a measured load current and the determined value of the internal impedance;

receive an indication of an input voltage of the voltage regulation device;

receive an indication of an output voltage of the voltage regulation device;

determine an induced voltage of the first winding based on the input voltage, the output voltage, and the voltage drop across the internal impedance; and determine a tap position of the tap changing mechanism relative to the first winding based on the induced voltage of the first winding, N, and a voltage of a second winding, wherein N is an integer value that represents a count of turns on the second winding.

2. The control system of claim 1, wherein the instructions further comprise instructions that, when executed, cause the one or more electronic processors to:

compare the determined tap position to the initial tap position, and determine whether to reassess the initial tap position based on the comparison.

3. The control system of claim 2, wherein to reassess the initial tap position, the instructions further comprise instructions that, when executed, cause the one or more electronic processors to:

determine a value of a second internal impedance of the voltage regulation device based on a second initial tap position;

determine a voltage drop across the second internal impedance based on a measured load current and the value of the second internal impedance;

determine a second induced voltage of the first winding based on the input voltage, the output voltage, and the voltage drop across the second the internal impedance; and determine a second tap position of the tap changing mechanism based on the second induced voltage of the first winding, N, and the voltage of the second winding.

4. The control system of claim 3, wherein the second initial tap position comprises the initial tap position increased or decreased by a pre-set amount.

5. The control system of claim 2, wherein the instructions that, when executed, cause the one or more electronic processors to compare the determined tap position to the initial tap position comprise instructions configured to determine a difference between the determined tap position and the initial tap position or a difference between a value associated with the determined tap position and a value associated with the initial tap position.

6. The control system of claim 5, wherein the determined tap position is reassessed if the difference does not meet a specification.

7. The control system of claim 6, wherein the difference does not meet the specification if the difference is outside of a range of values or if the difference is not equal to a pre-determined value.

8. The control system of claim 6, wherein the control system further comprises an output interface configured to provide an indication of the difference not meeting the specification.

9. The control system of claim 8, wherein the output interface comprises an interface configured to communicate with a remote station that is separate from the voltage regulation device, and the output interface provides the indication of the difference not meeting the specification to the remote station.

10. A voltage regulation device comprising:

a first winding comprising:

M turns, wherein M is an integer that is greater than one;

T taps, wherein T is an integer that is greater than one and at least one of the M turns is between any two of the T taps;

an input node configured to receive an input voltage;

an output node configured to provide an output voltage to a load;

a tap changing mechanism comprising a movable electrical contact configured make electrical contact with at least one of the T taps;

a second winding electrically connected to the first winding, the second winding comprising N turns, wherein N is an integer that is at least one; and a control system configured to determine a tap position of the tap changing mechanism, the tap position being a value that indicates which of the T taps is connected to the movable electrical contact, wherein the control system being configured to determine the tap position comprises the control system being configured to:

determine a value of an internal impedance of the voltage regulation device based on an initial tap position;

determine a voltage drop across the internal impedance based on a measured load current and the value of the internal impedance;

determine a voltage of the first winding based on the input voltage, the output voltage, and the determined voltage drop across the internal impedance; and determine the tap position based on the voltage of the first winding, N, and a voltage of the second winding.

11. The voltage regulation device of claim 10, wherein the control system is further configured to: compare the determined tap position to the initial tap position.

12. The voltage regulation device of claim 10, wherein the second winding is electrically connected to the input node of the first winding, and the voltage of the second winding is the input voltage.

13. The voltage regulation device of claim 10, wherein the second winding is electrically connected to the output node of the first winding, and the voltage of second winding is the output voltage.

14. The voltage regulation device of claim 10, further comprising a differential potential transformer configured to measure a voltage difference between the input node and the output node, and wherein the control system being configured to determine a voltage of the first winding based on the input voltage, the output voltage, and the voltage drop across the internal impedance comprises the control system being configured to determine the voltage of the first winding based on the measured voltage difference and the voltage drop across the internal impedance.

15. The voltage regulation device of claim 10, further comprising a load potential transformer and a source potential transformer, wherein the load potential transformer is configured to measure the output voltage, and the source potential transformer is configured to measure the input voltage, and wherein the control system is configured to determine the voltage of the first winding based on the input voltage measured by the source potential transformer, the output voltage measured by the load potential transformer, and the voltage drop across the internal impedance.

16. A method of determining a tap position of a voltage regulation device, the method comprising:

determining a value of an internal impedance of the voltage regulation device based on an initial tap position;

determining a voltage drop across the internal impedance based on a measured load current and the value of the internal impedance;

receiving an indication of an input voltage of the voltage regulation device;

receiving an indication of an output voltage of the voltage regulation device;

determining a voltage of the first winding based on the input voltage, the output voltage, and the voltage drop across the internal impedance; and determining the tap position based on the voltage of the first winding.

17. The method of claim 16, further comprising:

comparing the determined tap position to the initial tap position;

determining if the initial tap position is valid based on the comparison; and if the initial tap position is invalid:

changing the initial tap position to a second tap position; and determining a new tap position based on the second tap position.

18. The method of claim 17, further comprising:

if the second tap position is invalid:

changing the second tap position at least once;

determining a new tap position for each changed tap position; and determining if each new determined tap position is valid; and if no valid tap position is found, providing a perceivable indication related to no valid tap position being found to a remote station or to a separate electrical apparatus.

19. The method of claim 18, further comprising:

if a valid tap position is found, providing information related to the valid tap position to a remote station or a separate electrical apparatus.

20. The method of claim 16, further comprising: receiving a request to determine the tap position prior to determining the internal impedance of the voltage regulation device.

21. The control system of claim 1, wherein the value of the internal impedance is based on the initial tap position of the tap changing mechanism and on one or more pre-known quantities associated with the voltage regulation device.

22. The control system of claim 21, wherein the one or more pre-known quantities comprise one or more of the size of the first winding, the material or materials in the series winding, a pre-known value of the internal impedance associated with the initial tap position, and a pre-known value of the internal impedance associated with a tap position other than the initial tap position.

23. A control system for a voltage regulation device, the control system comprising:

one or more electronic processors; and a non-transitory machine readable storage medium comprising instructions, that when executed, cause the one or more electronic processors to:

determine an internal impedance of the voltage regulation device based on an initial tap position of a tap changing mechanism relative to a first winding of the voltage regulation device;

determine a voltage of the internal impedance based on a measured load current;

receive an indication of an input voltage of the voltage regulation device;

receive an indication of an output voltage of the voltage regulation device;

determine a voltage of the first winding based on the input voltage, the output voltage, and the voltage drop across the internal impedance;

determine a tap position of the tap changing mechanism relative to the first winding based on the voltage of the first winding, N, and a voltage of a second winding, wherein N is an integer value that represents a count of turns on the second winding;

compare the determined tap position to the initial tap position, and determine whether to reassess the initial tap position based on the comparison, and wherein to reassess the initial tap position, the instructions further comprise instructions that, when executed, cause the one or more electronic processors to:

determine a second internal impedance of the voltage regulation device based on a second initial tap position;

determine a voltage of the second internal impedance based on a measured load current;

determine a second voltage of the first winding based on the input voltage, the output voltage, and the voltage of the second the internal impedance; and determine a second tap position of the tap changing mechanism based on the second voltage of the first winding, N, and the voltage of the second winding.

24. A voltage regulation device comprising:

a first winding comprising:

M turns, wherein M is an integer that is greater than one;

T taps, wherein T is an integer that is greater than one and at least one of the M turns is between any two of the T taps;

an input node configured to receive an input voltage;

an output node configured to provide an output voltage to a load;

a tap changing mechanism comprising a movable electrical contact configured make electrical contact with at least one of the T taps;

a second winding electrically connected to the first winding, the second winding comprising N turns, wherein N is an integer that is at least one; and a control system configured to determine a tap position of the tap changing mechanism, the tap position being a value that indicates which of the T taps is connected to the movable electrical contact, wherein the control system being configured to determine the tap position comprises the control system being configured to:

determine a value of an internal impedance of the voltage regulation device based on an initial tap position;

determine a voltage drop across the internal impedance based on a measured load current;

determine a voltage of the first winding based on the input voltage, the output voltage, and the determined voltage drop across the internal impedance; and determine the tap position based on the voltage of the first winding, N, and a voltage of the second winding, wherein the voltage regulation device further comprises: a load potential transformer and a source potential transformer, wherein the load potential transformer is configured to measure the output voltage, and the source potential transformer is configured to measure the input voltage, and wherein the control system is configured to determine the voltage of the first winding based on the input voltage measured by the source potential transformer, the output voltage measured by the load potential transformer, and the voltage of the internal impedance.

25. A method of determining a tap position of a voltage regulation device, the method comprising:

determining an internal impedance of the voltage regulation device based on an initial tap position;

determining a voltage drop across the internal impedance based on a measured load current;

receiving an indication of an input voltage of the voltage regulation device;

receiving an indication of an output voltage of the voltage regulation device;

determining a voltage of the first winding based on the input voltage, the output voltage, and the voltage drop across the internal impedance;

determining the tap position based on the voltage of the first winding;

comparing the determined tap position to the initial tap position;

determining if the initial tap position is valid based on the comparison; and if the initial tap position is invalid:

changing the initial tap position to a second tap position; and determining a new tap position based on the second tap position; and if the second tap position is invalid:

changing the second tap position at least once;

determining a new tap position for each changed tap position; and determining if each new determined tap position is valid; and if no valid tap position is found, providing a perceivable indication related to no valid tap position being found to a remote station or to a separate electrical apparatus.

* * * * *